US011572806B2

(12) United States Patent
Fisher et al.

(10) Patent No.: US 11,572,806 B2
(45) Date of Patent: Feb. 7, 2023

(54) TURBINE BEARING MAINTENANCE APPARATUS AND METHOD

(71) Applicant: General Electric Company, Schenectady, NY (US)

(72) Inventors: Andrew James Fisher, Simpsonville, SC (US); Joseph Daniel Becker, Travelers Rest, SC (US); Lukasz Sajdak, Raszyn (PL); Piotr Hubert Wojciechowski, Warsaw (PL)

(73) Assignee: General Electric Company, Schenectady, NY (US)

( * ) Notice: Subject to any disclaimer, the term of this patent is extended or adjusted under 35 U.S.C. 154(b) by 148 days.

(21) Appl. No.: 17/192,115

(22) Filed: Mar. 4, 2021

(65) Prior Publication Data

US 2021/0189910 A1 Jun. 24, 2021

Related U.S. Application Data

(62) Division of application No. 16/037,326, filed on Jul. 17, 2018, now Pat. No. 10,968,780.

(30) Foreign Application Priority Data

Sep. 1, 2017 (EP) ..... 17461598

(51) Int. Cl.
*F01D 25/28* (2006.01)
*F01D 25/16* (2006.01)

(52) U.S. Cl.
CPC ..... *F01D 25/285* (2013.01); *F01D 25/16* (2013.01); *F05D 2220/32* (2013.01);
(Continued)

(58) Field of Classification Search
CPC ..... F01D 5/005; F01D 25/285
See application file for complete search history.

(56) References Cited

U.S. PATENT DOCUMENTS 4,236,859 A 12/1980 Steam; Richard A .... B63C 3/12 254/281
4,451,979 A * 6/1984 Schuster ..... F04D 29/64 29/889.1

(Continued)

FOREIGN PATENT DOCUMENTS

CN 108350756 A * 7/2018 ..... B23P 21/00
EP 1878662 A1 1/2008

(Continued)

OTHER PUBLICATIONS

European Search Report issued in connection with corresponding patent application serial No. 17461598.9 dated Mar. 23, 2018.

*Primary Examiner* — Jacob J Cigna
(74) *Attorney, Agent, or Firm* — James Pemrick; Charlotte Wilson; Hoffman Warnick LLC

(57) ABSTRACT

Various embodiments include methods for performing maintenance on a gas turbine bearing area. In some cases, a method includes: separating sections of an inlet bellmouth of the gas turbine without removing the sections of the inlet bellmouth from the gas turbine; removing a housing from over a bearing of the gas turbine; mounting a bearing maintenance apparatus adjacent the inlet bellmouth and the bearing; and performing maintenance on the bearing area while the sections of the inlet bellmouth remain separated.

13 Claims, 9 Drawing Sheets

(52) U.S. Cl.
CPC ..... *F05D 2230/68* (2013.01); *F05D 2240/50* (2013.01); *F05D 2240/52* (2013.01); *F05D 2260/02* (2013.01)

(56) References Cited

U.S. PATENT DOCUMENTS

| | | | | |
|---|---|---|---|---|
| 4,532,689 | A | 8/1985 | Harder et al. | |
| 4,645,083 | A * | 2/1987 | Vinciguerra | B66C 17/00 294/81.1 |
| 4,708,048 | A | 11/1987 | Brown | F41A 9/01 104/126 |
| 5,383,652 | A | 1/1995 | Van Den Berg | B25H 1/0007 269/17 |
| 5,631,541 | A | 5/1997 | Kabasawa et al. | |
| 5,653,351 | A | 8/1997 | Grout | B66C 19/005 212/315 |
| 5,816,367 | A | 10/1998 | Lilja | F01D 25/285 187/244 |
| 6,170,141 | B1 | 1/2001 | Rossway | F01D 25/285 206/319 |
| 7,770,292 | B2 | 8/2010 | Stretton | B66C 1/10 269/17 |
| 7,900,562 | B2 | 3/2011 | Esposti et al. | |
| 8,083,471 | B2 * | 12/2011 | Black | F01D 25/28 415/213.1 |
| 8,127,417 | B1 | 3/2012 | Butler et al. | |
| 8,590,151 | B2 | 11/2013 | Brown | F16M 1/04 29/889.1 |
| 8,672,606 | B2 | 3/2014 | Glynn | F01D 25/28 415/1 |
| 8,677,589 | B2 * | 3/2014 | Ziekow | F04D 29/624 414/589 |
| 8,720,059 | B2 | 5/2014 | West | F01D 25/285 248/544 |
| 8,833,776 | B2 | 9/2014 | Boulanger | B66F 9/06 280/35 |
| 9,038,253 | B2 * | 5/2015 | Herbold | F01D 25/285 29/270 |
| 9,309,008 | B2 | 4/2016 | Boulanger | B66F 7/0625 |
| 9,638,106 | B2 * | 5/2017 | Müller | F16C 35/00 |
| 9,714,585 | B2 | 7/2017 | Morey | B62B 3/02 |
| 10,253,650 | B2 * | 4/2019 | Müller | F23R 3/60 |
| 11,352,907 | B2 * | 6/2022 | Müller | F01D 25/285 |
| 2004/0055138 | A1 | 3/2004 | Tomko et al. | |
| 2012/0272496 | A1 * | 11/2012 | Herbold | B66C 1/107 29/402.03 |
| 2013/0333201 | A1 | 12/2013 | Fogel et al. | |
| 2014/0356152 | A1 | 12/2014 | Hynous | F01D 25/285 415/201 |

FOREIGN PATENT DOCUMENTS

| | | | |
|---|---|---|---|
| EP | 2610439 | A1 | 7/2013 |
| EP | 2811123 | A1 | 12/2014 |
| EP | 2896797 | A1 | 7/2015 |
| EP | 2955339 | A1 | 12/2015 |
| EP | 3156616 | A1 | 4/2017 |
| WO | 2017093581 | A1 | 6/2017 |

* cited by examiner

TURBINE BEARING MAINTENANCE APPARATUS AND METHOD

PRIORITY CLAIM

This application is a continuation filing of, and claims priority to, U.S. patent application Ser. No. 16/037,326 (filed Jul. 17, 2018), which itself claims priority to European Patent Application No. EP 17461598.9 (filed Sep. 1, 2017), the entire contents of each of which are incorporated by reference in its entirety.

FIELD

The subject matter disclosed herein relates to turbomachines. More particularly, the subject matter relates to gas turbomachines and associated maintenance apparatuses.

BACKGROUND

Conventional turbines, such as gas turbines, generally include three sections: a compressor section, a combustor section and a turbine section. The compressor section compresses ambient air, and provides that compressed air to the combustion section where it is combined with fuel to generate a heated working fluid (gas). The heated gas is provided to the turbine section, where it impacts turbine blades to drive rotation of the turbine rotor shaft.

The rotor shaft is sometimes coupled with a dynamoelectric machine such as a generator (e.g., via a coupled shaft), which converts the rotational energy of the turbine into electrical energy. In other cases, the rotor shaft is coupled with an accessory box or other system. In either case, the rotor shaft is coupled with an external shaft (e.g., from the accessory box or dynamoelectric machine). This coupling is surrounded and protected by a thrust bearing. The thrust bearing can provide mechanical support to the shafts, and dissipate thrust from the turbine during operation. The thrust bearing is located adjacent the inlet bellmouth of the turbine's compressor section, and is protected by a bearing housing. The bearing area also includes a journal bearing, which withstand radial loads applied to the rotor. Additional components within the bearing housing area can include lift oil piping, thermocouple wiring, and other instrumentation.

When performing maintenance on the shafts or the thrust bearing, conventional approaches require completely removing the inlet bellmouth in order to access the bearing (and shafts) under the housing. The inlet bellmouth is formed in two halves around the turbine shaft, and is interconnected with other components in the compressor section. Because of the significant weight of the bearings (e.g., up to 225 kilograms per half), conventional approaches require clearance in order to manipulate these components. Conventional approaches for maintenance on the bearing area, including thrust and journal bearings, involve the use of an overhead crane that lifts the upper half of the inlet bellmouth to remove it from the assembly. As such, maintenance approaches that require complete removal of the inlet bellmouth are expensive, cumbersome and time-consuming.

BRIEF DESCRIPTION

Various embodiments include apparatuses for performing maintenance on a gas turbine bearing area, along with related methods. One apparatus can include: a set of rails sized to couple with the gas turbine and rest coaxially with a bearing in the bearing area adjacent the gas turbine, the set of rails for supporting a portion of a housing of the bearing; a first platform spanning between the set of rails; a lifting device coupled to the first platform for engaging an inlet bellmouth of the gas turbine; and a second platform suspended from the set of rails sized to accommodate an operator.

A first aspect of the disclosure includes an apparatus for performing maintenance on a bearing area of a gas turbine, the apparatus having: a set of rails sized to couple with the gas turbine and rest coaxially with a bearing in the bearing area adjacent the gas turbine, the set of rails for supporting a portion of a housing of the bearing; a first platform spanning between the set of rails; a lifting device coupled to the first platform for engaging an inlet bellmouth of the gas turbine; and a second platform suspended from the set of rails sized to accommodate an operator.

A second aspect of the disclosure includes a method of performing maintenance on a bearing area of a gas turbine, the method including: separating sections of an inlet bellmouth of the gas turbine without removing the sections of the inlet bellmouth from the gas turbine; removing a housing from over a bearing in the bearing area within the gas turbine; mounting a bearing maintenance apparatus adjacent the inlet bellmouth and the bearing, the bearing maintenance apparatus having: a set of rails sized to couple with the gas turbine and rest coaxially with the bearing, the set of rails for supporting the bearing housing; a first platform spanning between the set of rails; a lifting device coupled to the first platform for engaging the inlet bellmouth; and a second platform suspended from the set of rails sized to accommodate an operator; and performing maintenance on the bearing area while the sections of the inlet bellmouth remain separated.

A third aspect of the disclosure includes a method of performing maintenance on a gas turbine having a shaft, a bearing for the shaft, a bearing housing and a turbine inlet bellmouth adjacent the bearing housing, the method including performing in-situ maintenance on a bearing area of the gas turbine by: separating sections of an inlet bellmouth of the gas turbine without removing the sections of the inlet bellmouth from the gas turbine; removing a housing from over the bearing of the gas turbine; mounting a bearing maintenance apparatus adjacent the inlet bellmouth and the bearing; and performing maintenance on the bearing area while the sections of the inlet bellmouth remain separated, wherein while performing the in-situ maintenance, the bearing maintenance apparatus is mounted to the gas turbine such that an operator can access the bearing area from below the shaft.

BRIEF DESCRIPTION OF THE DRAWINGS

These and other features of this disclosure will be more readily understood from the following detailed description of the various aspects of the invention taken in conjunction with the accompanying drawings that depict various embodiments of the invention, in which.

Figure 1:
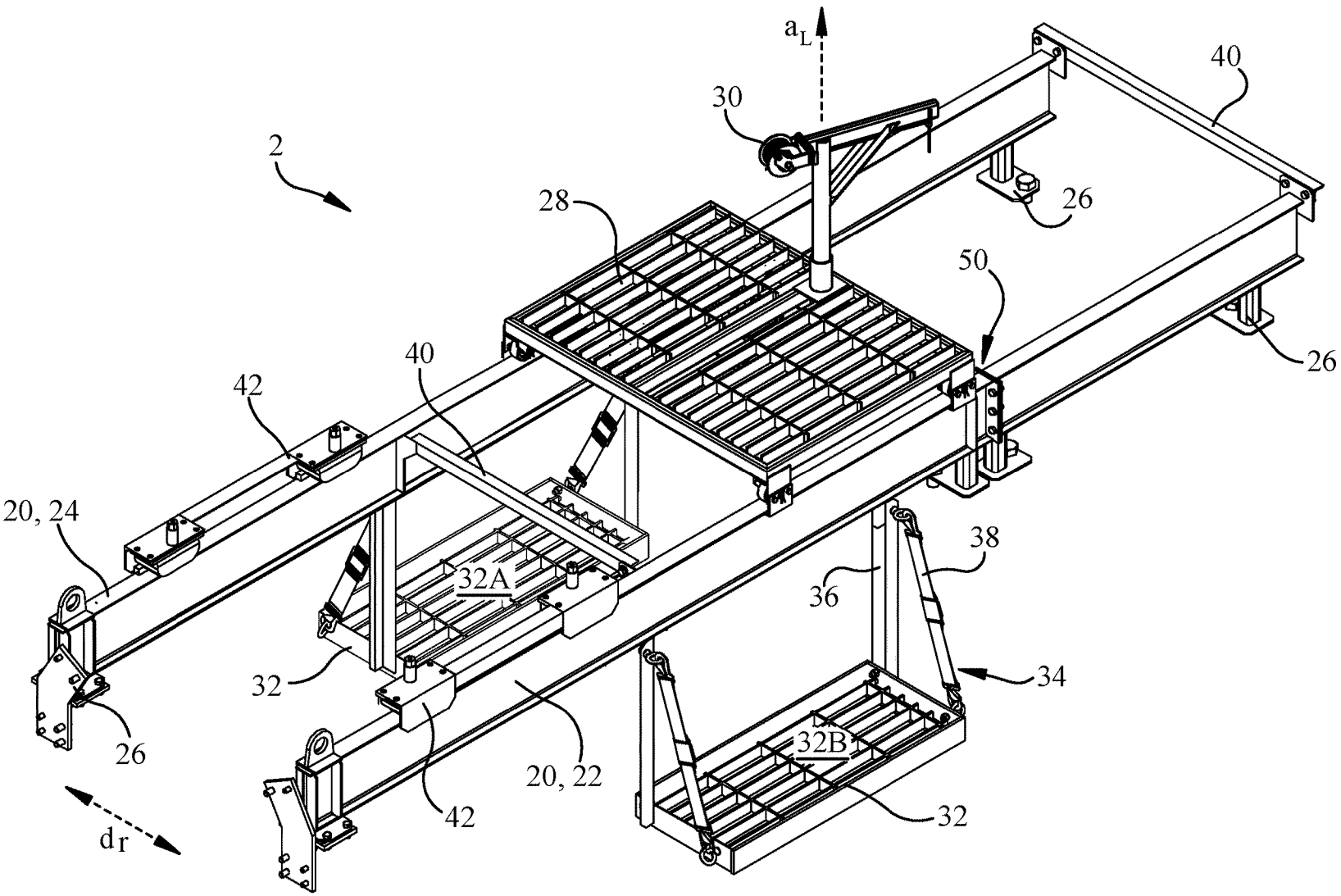
FIG. 1 shows a schematic perspective view of an apparatus according to various embodiments of the disclosure.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION

As noted, the subject matter disclosed herein relates to turbomachines. More particularly, the subject matter relates to gas turbomachines and associated maintenance apparatuses for gas turbomachine bearings and associated equipment.

In contrast to conventional approaches, various embodiments of the disclosure include a maintenance apparatus for a gas turbine configured to access and remove components, such as the turbine thrust bearing, journal bearing, piping and/or wiring without completely removing the turbine's inlet bellmouth. That is, the maintenance apparatuses and approaches disclosed according to various embodiments allow for access of the bearing area and related housing from underneath the turbine assembly, obviating the overhead crane used in conventional approaches.

Figure 2:
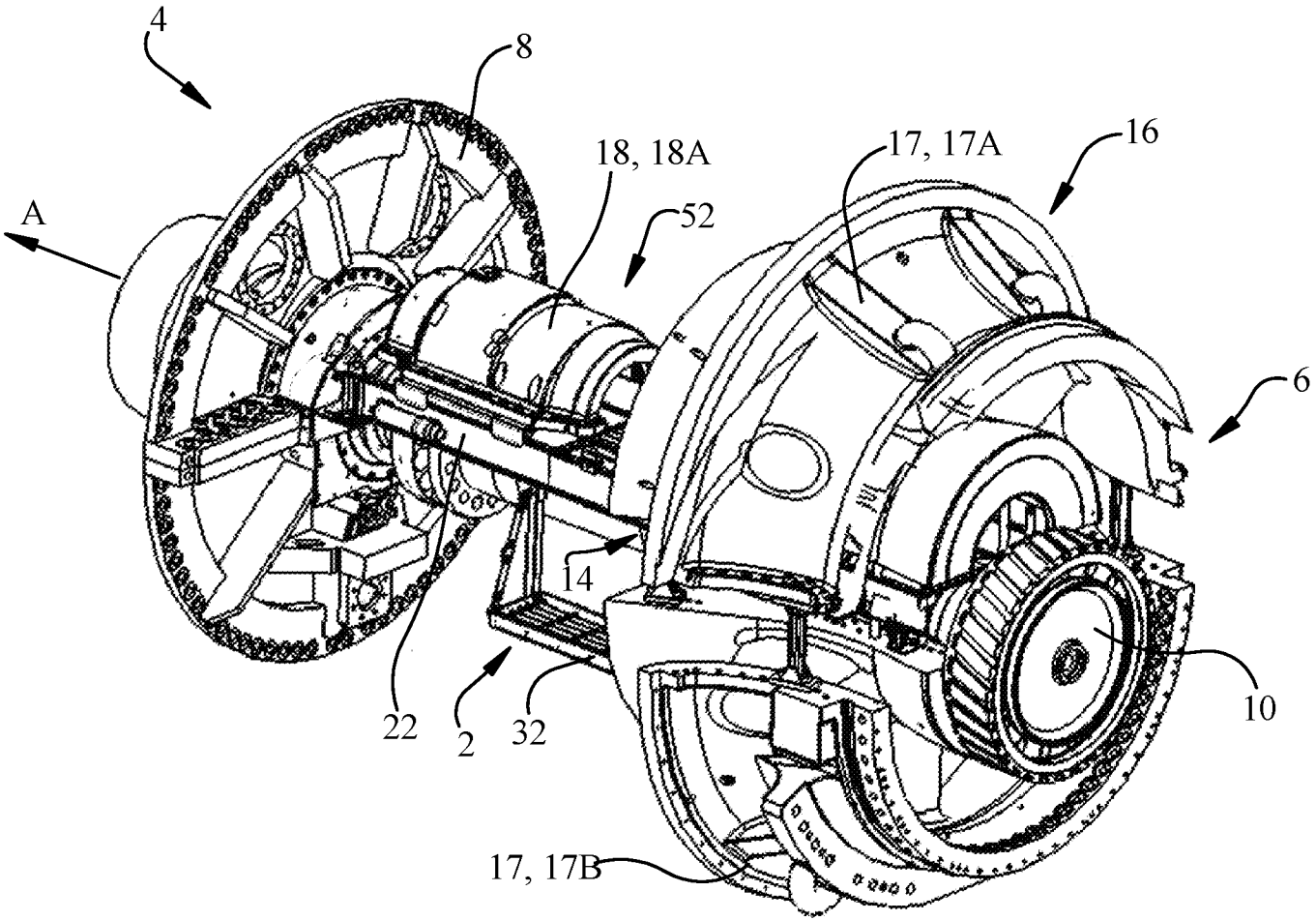
FIG. 2 shows a schematic perspective view of an apparatus and a portion of a turbine according to various embodiments of the disclosure.
Figure 3:
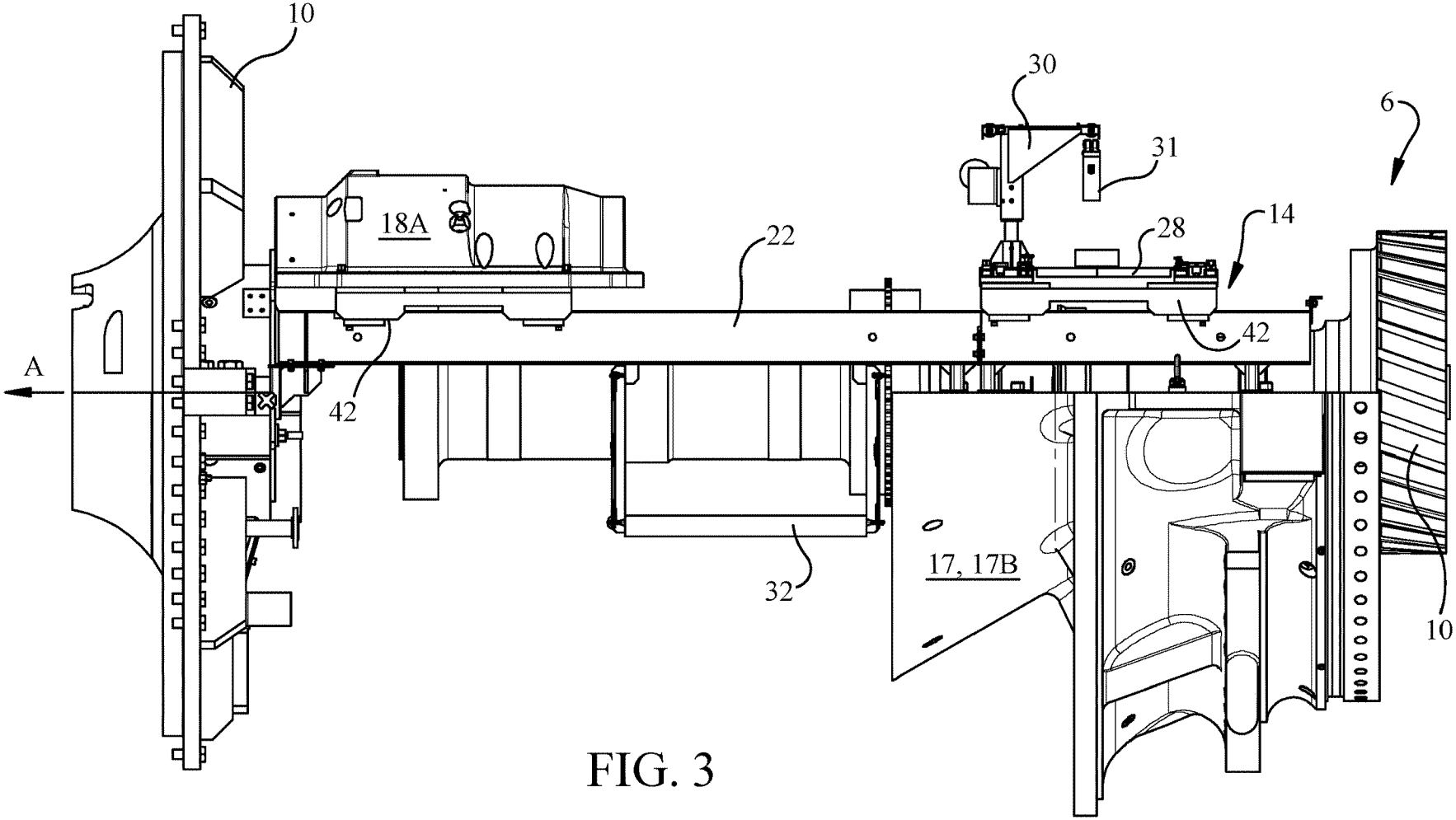
FIG. 3 shows a schematic side view of the apparatus and a portion of a turbine according to various embodiments of the disclosure.
Figure 4:
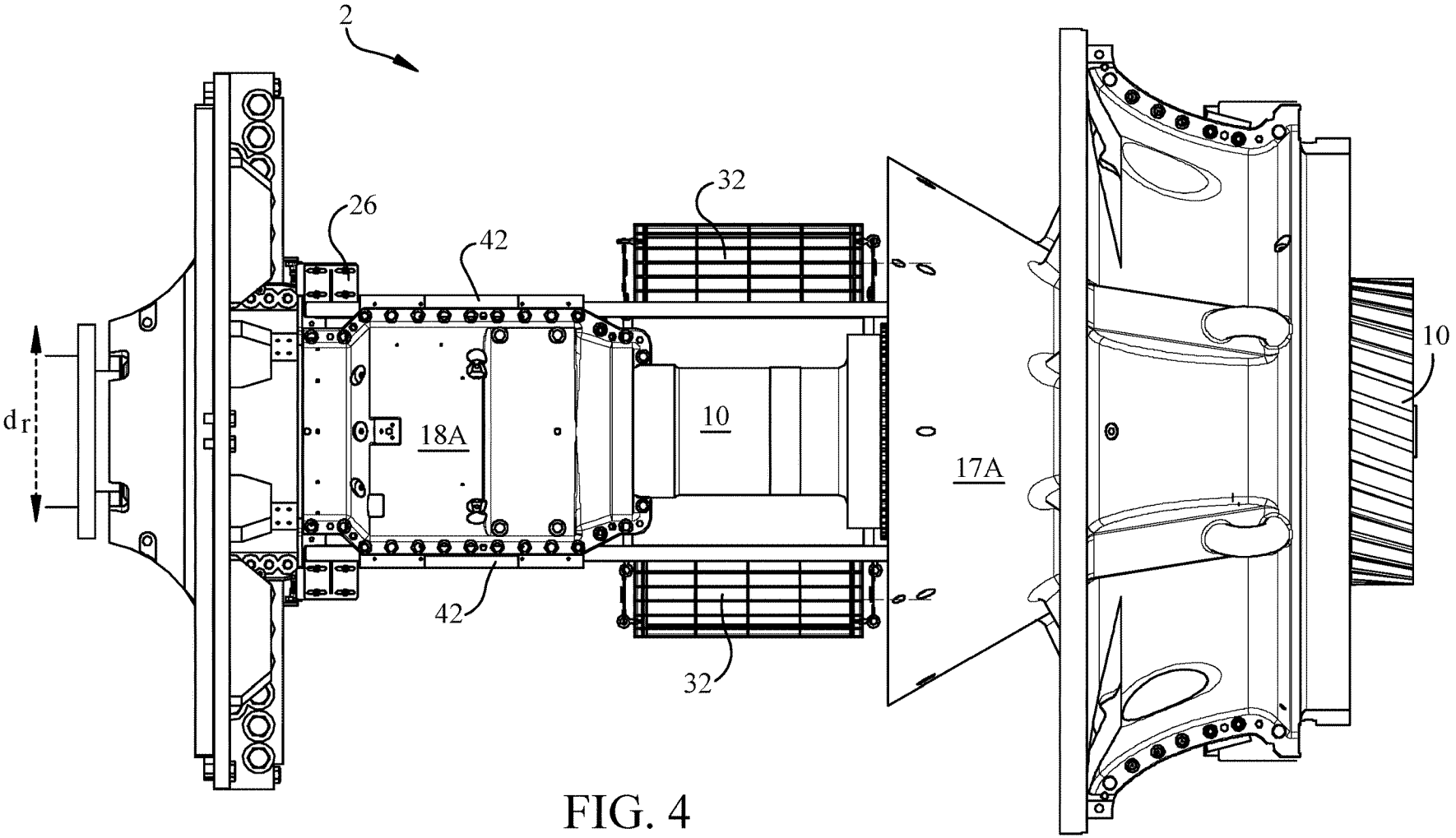
FIG. 4 shows a schematic top view of another embodiment of an apparatus along with a section of a bearing housing according to embodiments of the disclosure.
Figure 5:
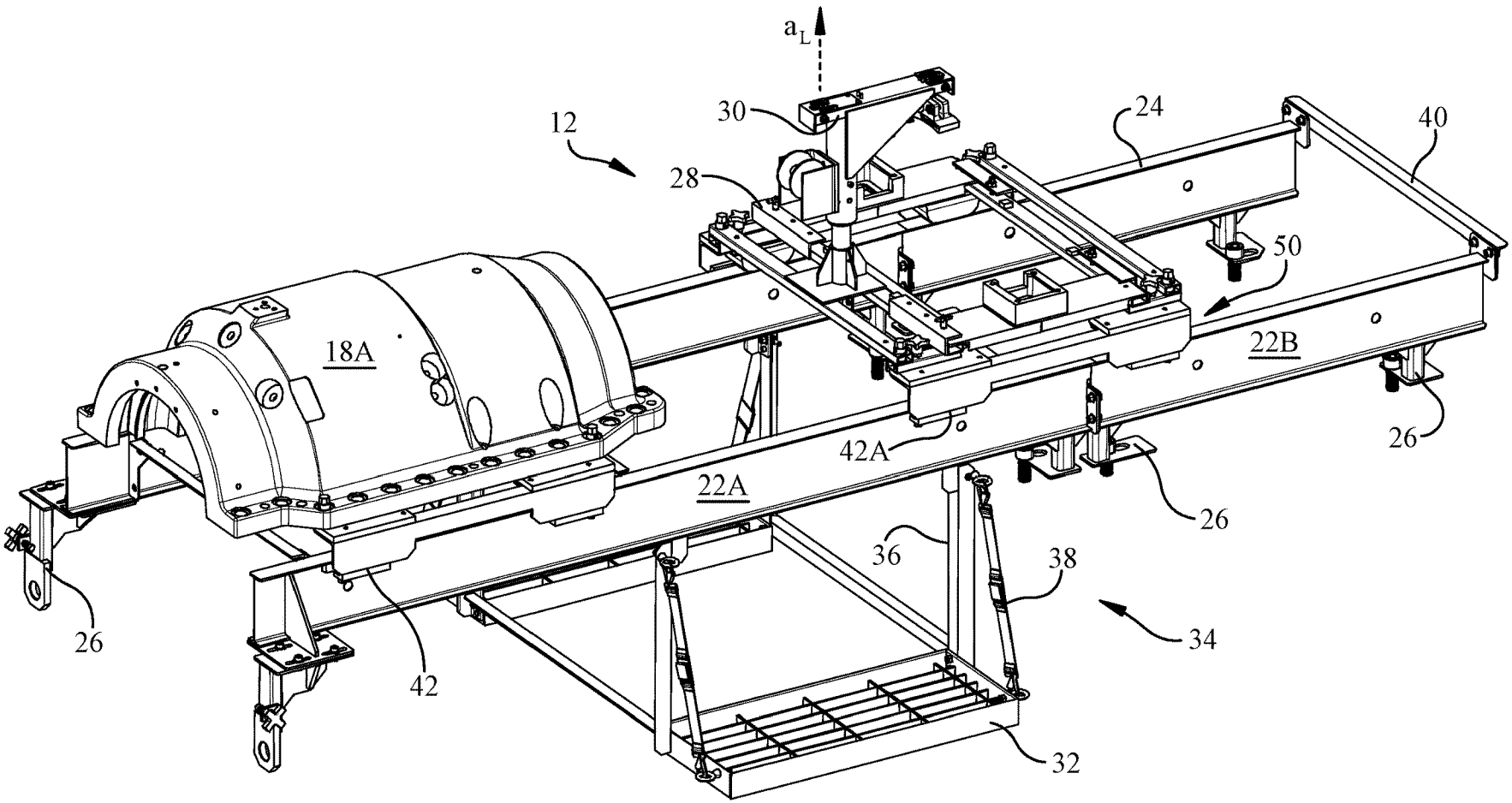
FIG. 5 shows a schematic perspective view of the apparatus and bearing housing of FIG. 4.
Figure 7:
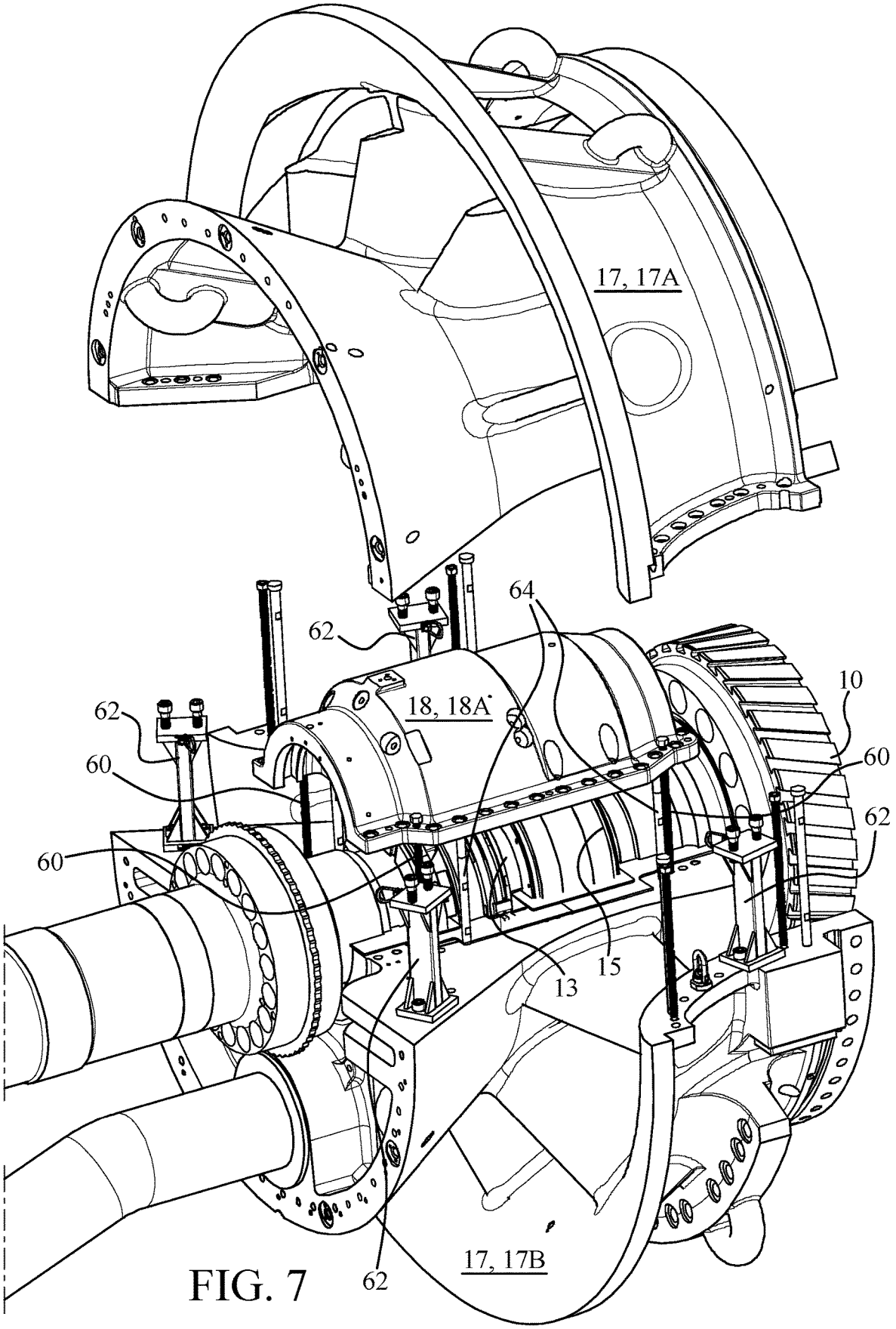
FIG. 7 shows a schematic blow-out view of a portion of a turbine during a maintenance process as described with respect to the flow diagram of FIG. 6.

Turning to FIG. 1, a schematic three-dimensional depiction of a bearing maintenance apparatus (or simply, apparatus) 2 is shown according to various embodiments. FIG. 2 shows a schematic depiction of a system 4 including apparatus 2 mounted to a portion of a turbine 6 (e.g., a gas turbine), along with a portion of a dynamoelectric machine 8 (shown as optional embodiment) coupled with the turbine via a shaft 10. FIG. 3 illustrates a side view of apparatus 2 from FIGS. 1-2. FIG. 4 shows a top view of the apparatus 2 along with a portion of a bearing housing, and FIG. 5 shows a perspective view of the apparatus and housing of FIG. 4. FIG. 7 shows a schematic blow-out depiction of a portion of turbine 6 undergoing processes according to various embodiments described herein. Due to the various angles and depictions of apparatuses 2, FIGS. 1-5 and 7 are referred to simultaneously.

Apparatus 2 is configured (e.g., sized) for use in performing maintenance on a bearing area 14, which can include a thrust bearing 13, journal bearing 15 and/or other wiring and piping proximate thrust bearing 13 and journal bearing 15 (FIG. 2, FIG. 7) of a turbine (e.g., a gas turbine). As is known in the art, the thrust bearing 13 and journal bearing 15 reside on shaft 10 (FIG. 2) outside of the turbine casing 16 (FIG. 2). As shown in FIG. 2, turbine casing 16 is partially shown as sections of an inlet bellmouth 17. Within bearing area 14, thrust bearing 13 (FIG. 7) can help to dampen the mechanical force applied to shaft 10 by rotation of blades (not shown) within turbine 6. Journal bearing 15 can additionally dampen the mechanical force applied to shaft 10, e.g., by dampening rotational force. Thrust bearing 13 and journal bearing 15, along with additional wiring and piping, are encased by a bearing housing 18, an upper half 18A of which is illustrated in FIGS. 2-5 and 7. In some cases, as is known in the art, shaft 10 is coupled with a dynamoelectric machine 8, as illustrated in FIGS. 2-4, however, according to various embodiments, shaft 10 may be free or coupled to a distinct system. In various embodiments, apparatus 2 and its components are formed of a metal (e.g., steel), alloy(s), or other composite material capable of withstanding the mechanical stresses associated with the functions described herein. In some cases, apparatus 2 includes components formed integrally (e.g., via casting, additive manufacturing, etc.) and/or formed separately and subsequently coupled (e.g., via mechanical fastening, bolting, clamping, etc.).

As shown, apparatus 2 can include a set of rails 20 (FIGS. 1, 4 and 5) sized to couple with gas turbine 6 and rest coaxially with a bearing (e.g., thrust bearing 13 and/or journal bearing 15) adjacent turbine 6. In various embodiments, the set of rails 20 can include two distinct, parallel rails 22, 24 (FIGS. 1, 4 and 5). Rails 22, 24 can be separated by a distance $d_R$ (FIGS. 1, 4 and 5) that is less than approximately an outer diameter of bearing housing 18 and greater than approximately an inner diameter of the bearing housing 18. These rails 22, 24 can be used to support a portion of bearing housing 18, e.g., to allow for effective maintenance of thrust bearing 13, journal bearing 15 and other associated components such as wiring, piping, etc. within bearing housing 18. Rails 22, 24 can include mounts 26 (FIGS. 1, 4 and 5) for coupling with gas turbine 6 and/or dynamoelectric machine 8 or other system. Mounts 26 can be fastened, bolted, screwed, or otherwise coupled to gas turbine 6, dynamoelectric machine 8, or other systems.

As noted herein, rails 22, 24 can rest coaxially with thrust bearing 13, journal bearing 15 (as well as housing 18), and the primary axis (of rotation) of turbine 6 (direction A, FIG. 2). That is, during use of maintenance apparatus 2, 12, rails 22, 24 can be positioned parallel with axis A, and may each be approximately (+/−several percent) equidistant from thrust bearing 13 and journal bearing 15, respectively.

In various embodiments apparatus 2 further includes a first platform 28 spanning between the set of rails 20 (rails 22, 24), and a lifting device 30 coupled (e.g., mechanically fastened, bolted/screwed, integrally formed, etc.) to first platform 28 for engaging inlet bellmouth 17 of turbine 6. Lifting device 30 can include a winch or a pneumatic lift, and in some cases, can be configured to rotate about an axis $a_L$ to transport components for use in maintenance of bearing area 14 (e.g., on thrust bearing 13, journal bearing 15, etc.). Additionally, lifting device 30 may be used to modify a position of inlet bellmouth 17, e.g., by raising or lowering an upper half 17A of inlet bellmouth 17 relative to first platform 28. Lifting device 30 may also be used to transport other components 31 to/from first platform 28.

In various embodiments, apparatus 2 can include a second platform 32 suspended from set of rails 20 (e.g., rail 22 and/or rail 24), where second platform 32 is sized to accommodate an operator (e.g., a human operator). In various embodiments second platform 32 is coupled with rails 20 by a suspension system 34, which may include a fixed support 36 and a hinged support 38. In some cases, second platform 32 is positioned below bearing area 14 (and housing 18) while apparatus 2, 12 is mounted to turbine 6, such that an operator can access bearing area 14 from underneath shaft 10. In various embodiments, second platform 32 is a single platform (FIG. 4) spanning across the distance between rails 22, 24, but in other cases, second platform 32 includes two distinct platforms 32A, 32B separated from distinct rails 22, 24, respectively.

In some cases, apparatus 2 further includes at least one cross-brace 40 spanning between rails 22, 24, e.g., for stabilizing rails 22, 24. Cross-brace(s) 40 may be located at one or more points along set of rails 20, including proximate platforms 28, 32. Cross-braces 40 can be used for torsional and bending support/bracing.

In various embodiments, apparatus 2 further includes a cart system 42 coupled with rails 22, 24, for sliding bearing housing 18 axially along set of rails 20. That is, according to various embodiments, cart system 42 is configured to support a portion (e.g., upper half 18A) of bearing housing 18 and allow that portion of housing 18 to move along the axis of rails 22, 24 such that an operator can access the bearing area 14. Cart system 42 can include a mechanical rail system (e.g., a gear-based rail system), a hydraulic rail system (e.g., using a hydraulic pump and cylinders), or any other suitable transport system coupled to rails 22, 24 and capable of moving axially along rails 22, 24. As described herein, rails 22, 24 are spaced such that bearings (e.g., thrust bearing 13 and/or journal bearing 15) are configured to be located between those rails 22, 24 while apparatus 2, 12 is mounted to turbine 6. In some cases, an additional cart system 42A is used to support and/or transport lifting device 30, e.g., along rails 22, 24.

In some cases, each rail 22, 24 includes two distinct rail sections 22A, 22B and 24A, 24B coupled at axial ends 50 of those sections. In various embodiments, the distinct rail sections 22A, 22B and 24A, 24B can be configured to couple and uncouple to allow access to the space between turbine 6 and an adjacent system (e.g., dynamoelectric machine 8). In these instances, rail sections 22A, 22B and 24A, 24B can be separately inserted in an area 52 (FIG. 2) adjacent turbine 6 and assembled when aligned with shaft 10 (or around shaft 10).

Figure 6:
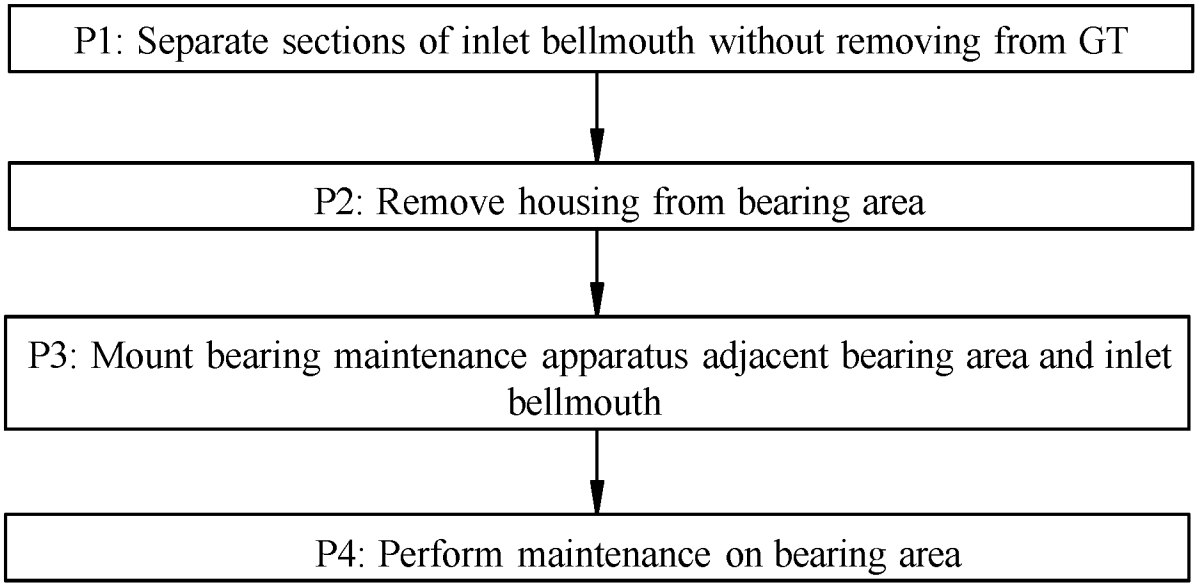
FIG. 6 shows a flow diagram depicting an illustrative method according to various embodiments of the disclosure.

According to various embodiments, apparatus 2, 12 may be used in a method of performing maintenance on bearing area 14. FIG. 6 is a flow diagram illustrating various processes according to embodiments of the disclosure. These processes can apply to some of the apparatuses and components shown and described with reference to FIGS. 1-5 and 7-9, however, these processes are not intended to be limited to those particular components shown and described with reference to those Figures Additionally, processes may be omitted, added or otherwise reordered according to various embodiments. In some embodiments, processes include:

Process P1: separating sections (upper half 17A and lower half 17B) of inlet bellmouth 17 of gas turbine 6 without removing the sections 17A, 17B of inlet bellmouth 17 (FIG. 2) from gas turbine 6. In various embodiments, this can include using a hydraulic ram or other lifting device to lift upper half 17A of inlet bellmouth 17 away from shaft 10, and can further include using conventional jack-stands to maintain the height of upper half 17A (shown separated in FIG. 7).

Process P2: lifting housing 18 within the bearing area 14. This can include using a jack or other lifting device to separate upper half 18A of housing 18 from the lower half of housing 18 (lower half not shown). In some cases, this process is performed by lifting housing 18A with mechanical screws 60 (FIG. 7). Mechanical screws 60 can be actuated to separate sections of housing 18A, 18B (lower half partially obstructed). Additionally, in a preliminary process, it is understood that the upper half of inlet bellmouth 17A can also be lifted using a jack 62 or other lifting device, in order to provide clearance for mechanical screws 60 to elevate upper half of housing 18A. In some cases, guide rods 64 are coupled with lower half 17B of inlet bellmouth 17 and upper half 18A of housing 18 to keep bearing housing 18A in place.

Process P3: mounting bearing maintenance apparatus 2 adjacent inlet bellmouth 17 and bearing area 14. This process can include coupling apparatus 2, 12 to turbine 6, e.g., via mounts 26, and to dynamoelectric machine 6, in various embodiments. In various embodiments, bearing housing 18, e.g., upper half 18A of housing 18 can be loaded onto cart system 42 to slide that portion of housing 18 axially relative to thrust bearing 13 and journal bearing 15 (and allow for maintenance on thrust bearing 13 and/or journal bearing 15, along with other components in bearing area 14). In some cases, apparatus 2 can be at least partially assembled on location, but in other cases, one or more portions of apparatus 2 are pre-assembled. In an example where apparatus 2 is at least partially assembled on location: once the inlet bellmouth 17A is lifted and secured, the bearing housing 18 will be lifted high enough off of the lower half 17B of inlet bellmouth's surface such that the maintenance apparatus 2 can be configured underneath. In some cases, rail sections 22B are installed first, and then mounts 26 are used to couple apparatus 2 to dynamoelectric machine 8 and/or an accessory gear box (not shown). Subsequently, rail sections 22A can be added to rail sections 22B, along with cross-brace(s) 40. Platforms 28 and 32 may also be added, and cart system 42 (e.g., including rollers and/or a jib system) can be installed. As described herein, housing 18A can be loaded onto cart system 42 for transport along apparatus 2.

Figure 8:
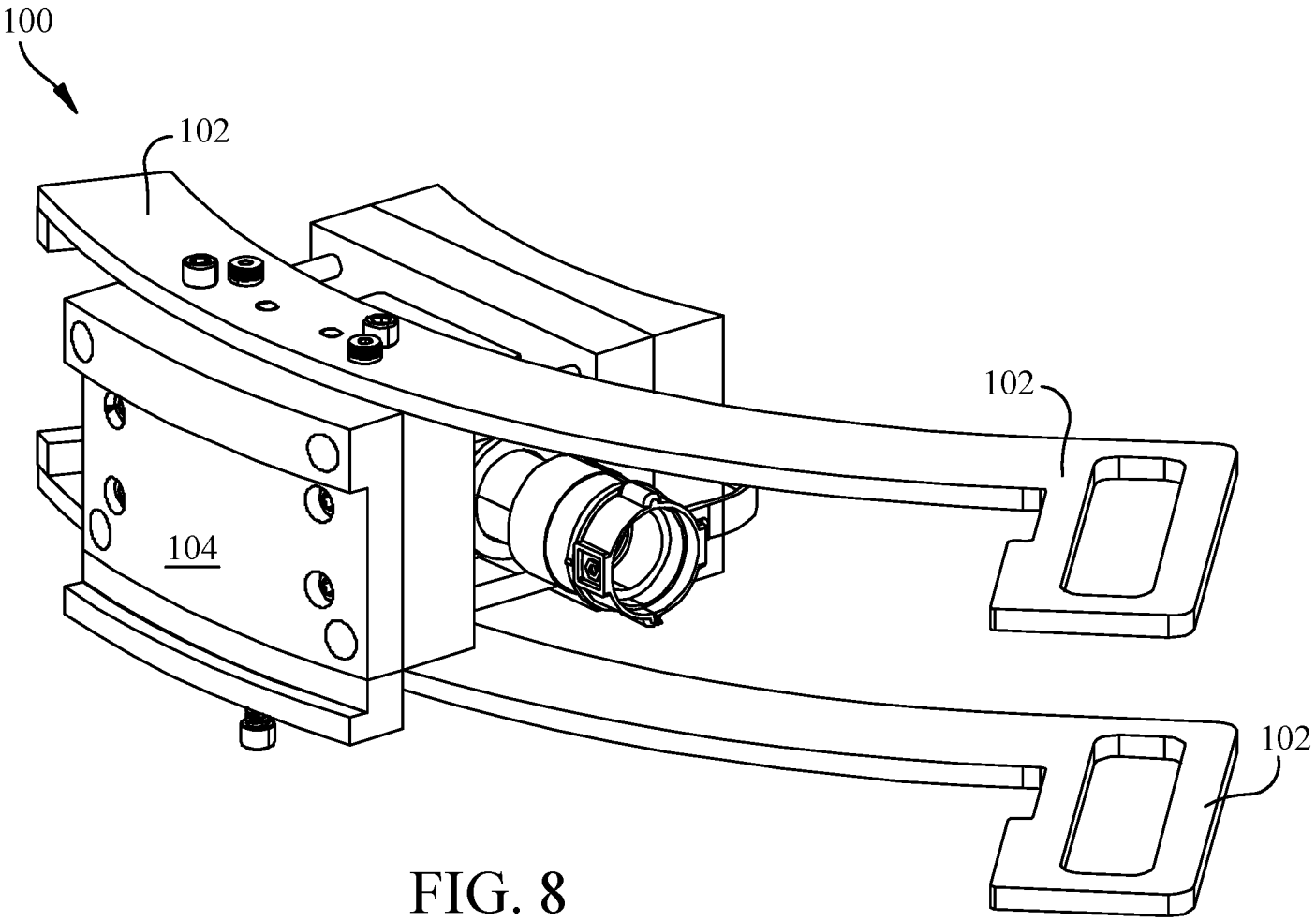
FIG. 8 shows a schematic depiction of a hydraulic lifting system for a rotor according to various embodiments of the disclosure.
Figure 9:
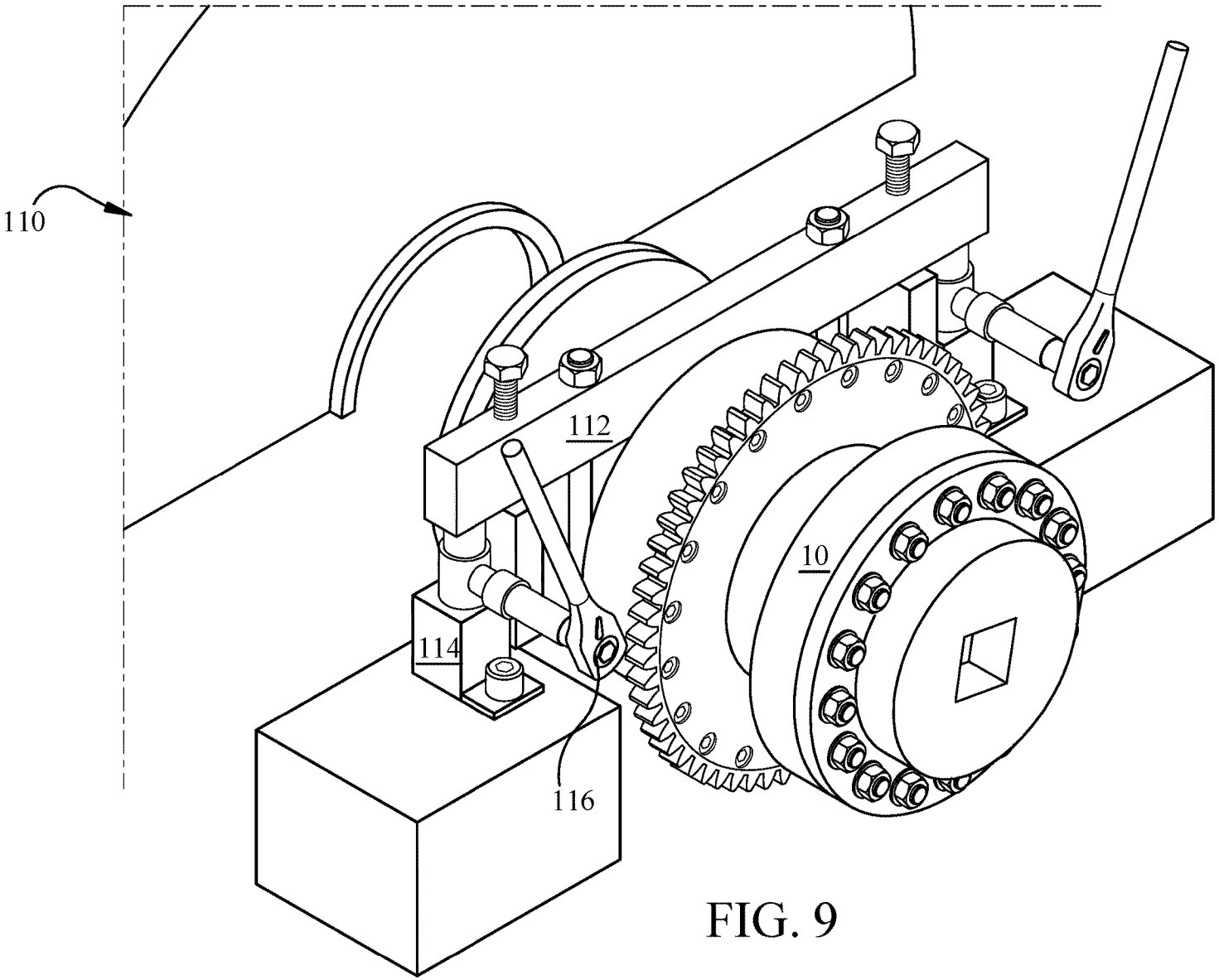
FIG. 9 shows a schematic depiction of a mechanical lifting system for a rotor according to various embodiments of the disclosure.

Process P4: performing maintenance on bearing area 14 while sections 17A, 17B of the inlet bellmouth 17 remain separated (depicted in FIG. 2). According to various embodiments, an operator (e.g., a human and/or robotic operator) may use first platform 28 and/or second platform(s) 32. In some cases, scaffolding will be built in this area. In some cases, an external jack or lifting device may be used to elevate rotor (shaft 10) of gas turbine 6. FIG. 8 shows a schematic view of an example hydraulic rotor (shaft) 10 support system 100, configured to elevate shaft 10 of gas turbine 6 in conjunction with the maintenance operations described herein. In various embodiments, support system 100 includes at least one mount 102 for mounting support system 100, and a hydraulic jack 104 coupled with mount 102 to engage shaft 10 and lift the rotor. Hydraulic jack 104 can be actuated, e g, manually or via a control system, to raise and/or lower shaft 10. FIG. 9 shows an example mechanical support system 110 engaged with a rotor (shaft) 10. Mechanical support system 110 can include a mount 112 and a mechanical jack 114 coupled with mount 112 to engage shaft 10 and lift the rotor. Mechanical jack 114 can be actuated manually, e.g., using one or more tools 116 such as wrenches. These support systems 100, 110 can help provide the significant force required to manipulate shaft 10 and perform maintenance processes described herein. In some cases, e.g., after elevating shaft 10, an operator may rotate thrust bearing 13 and/or journal bearing 15 to a top-dead-center position. In various embodiments, thrust bearing 13 and/or journal bearing 15 can all be rotated by hand without lifting gas turbine shaft 10. Shaft 10 can be moved axially, e.g., via hydraulic support systems 100, 110, in order to remove bearings 13, 15 and related assemblies.

In various embodiments, only the lower half of thrust bearing 13 and/or journal bearing 15 requires the shaft 10 to be lifted. At that point, a lifting jib assembly can be used to rotate the lower half of thrust bearing 13 and/or journal bearing 15 to top dead center for subsequent lifting and removal. Additionally, after rotating thrust or journal bearings 13, 15 to top-dead-center, that bearing 14 can be separated (e.g., into component pieces, such as halves), and removed from rotor (shaft 10). The bearings 13, 15 can then be repaired, refurbished or replaced, and inserted back onto rotor (shaft 10) according to conventional approaches. That is, a replacement thrust bearing and/or journal bearing or refurbished thrust bearing and/or journal bearing may be inserted back onto rotor (shaft 10) in various embodiments.

As described herein, during the maintenance process described with respect to FIG. 6, second platform 32 is positioned below bearing area 14 while maintenance apparatus 2 is mounted to gas turbine 6. This can allow an operator, e.g., human and/or robotic operator to access the bearing area 14 from below shaft 10, and reduce (or eliminate) the need for overhead equipment such as an overhead crane. Additionally, apparatus 2 can allow an operator (e.g., human and/or robotic) to perform maintenance on bearing area 14 without completely removing inlet bellmouth 17 from the gas turbine 6. Apparatus 2 can reduce the time required to perform maintenance on bearing area 14, and simplify the process of accessing that bearing area 14, relative to conventional systems and approaches.

As noted herein, apparatus 2 can eliminate or significantly reduce the overhead obstacles that are present in conventional approaches to access bearing area 14. These conventional approaches require completely lifting the bellmouth 17A with a crane to access bearing area 14. Occasionally, maintenance operators attempt to perform some of this maintenance without tooling or with makeshift tooling, which is both dangerous and time consuming due to the heavy part manipulation in a confined space. Further, due to the weight of components in bearing area 14, e.g., the bearing housing 18 which may weigh thousands of pounds, apparatus 2 can be used to replace laborious, dangerous and time-consuming transportation processes conventionally performed by hand.

In one example process according to embodiments: The bearing housing 18 is first removed as explained herein. The thrust bearing 13 is then removed once the bearing housing 18 is separated. The thrust bearing 13 is an assembly made up of an upper and lower half, one forward and one aft assembly, including thrust pads and a thrust "cage" (holding pads in place). Thrust bearing 13 may also include instrumentation on the thrust bearing pads, such as thermocouples at various locations. The pads and sometimes the cages (depending upon size) can be removed by hand. If not removed by hand, in some cases there are custom lifting brackets for rigging and lifting the thrust cages with the jib and roller assembly. Next, the upper half journal bearing 15 can be lifted and removed. This may involve assisted lifting because the journal bearing halves can weigh between 50 kilograms (kg) to 250 kg (~100-500 pounds (lbs)) each, depending upon the gas turbine frame size. After the upper half of journal bearing 15 is removed, the lower half is isolated from the weight of the rotor (shaft 10) so that it can roll to top dead center for lifting and complete removal. There are various conventional methods of "jacking" or lifting the rotor (shaft 10), e.g., approximately 0.025-0.040 centimeters (~0.010-0.015 inches). The shaft 10 can be lifted using mechanical and/or hydraulic systems, further described herein with reference to FIGS. 9 and 10. In some cases, hydraulic is preferred, due to the level of force needed to lift the rotor (which weighs over 23,000 kg, or around 50,000 lbs). As noted herein, apparatus 12 can be installed in thrust bearing area 14 (or "cavity") in the lower half bellmouth casing 17B. At this point, the rotor surface (shaft 10) can be jacked, e.g., with small (e.g., 10 ton) jacks pushing up at a slight angle (or mechanical screw-type jacks). The lower half of journal bearing 15 can then be rigged to a jib, and tension applied to start rolling the journal bearing half 15 to top dead center. In some cases, the jib will only roll the journal bearing 15 so far, so other items may be used to help continue to roll the journal bearing 15 all the way up to top-dead-center. Due to low overhead clearance, once at top-dead-center, a special lifting bracket may be attached to the journal bearing 15 to lift that bearing 15 onto the apparatus 12 and remove it from the area.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A method of performing maintenance on a bearing area of a gas turbine, the method comprising:

separating sections of an inlet bellmouth of the gas turbine without removing the sections of the inlet bellmouth from the gas turbine;

removing a housing from over a bearing of the gas turbine;

mounting a bearing maintenance apparatus adjacent the inlet bellmouth and the bearing, the bearing maintenance apparatus having:

a set of rails sized to couple with the gas turbine and rest coaxially with the bearing, the set of rails for supporting a portion of the housing;

a first platform spanning between the set of rails;

a lifting device coupled to the first platform for engaging the inlet bellmouth; and a second platform suspended from the set of rails sized to accommodate an operator; and performing maintenance on the bearing area while the sections of the inlet bellmouth remain separated.

2. The method of claim 1, wherein the second platform is positioned below the bearing area while the maintenance apparatus is mounted to the gas turbine.

3. The method of claim 1, wherein the set of rails includes two rails, and wherein each of the two rails is substantially perpendicular with a primary axis of the gas turbine while the maintenance apparatus is mounted to the gas turbine, wherein the bearing is configured to be located between the two rails while the apparatus is mounted to the gas turbine.

4. The method of claim 1, wherein the maintenance apparatus includes a cart system coupled with the set of rails, the cart system for sliding the bearing housing axially along the set of rails.

5. The method of claim 1, wherein performing maintenance on the bearing area includes elevating a rotor of the gas turbine and rotating a journal bearing in the bearing area bearing to top-dead-center.

6. The method of claim 5, wherein performing maintenance on the bearing area further includes removing the bearing from the rotor.

7. The method of claim 6, wherein performing maintenance on the bearing area further includes replacing the bearing with a replacement bearing.

8. The method of claim 6, wherein performing maintenance on the bearing area further includes refurbishing the bearing and installing the refurbished bearing around the rotor.

9. A method of performing maintenance on a gas turbine having a shaft, a bearing for the shaft, a bearing housing and a turbine inlet bellmouth adjacent the bearing housing, the method comprising performing in-situ maintenance on a bearing area of the gas turbine by:

separating sections of an inlet bellmouth of the gas turbine without removing the sections of the inlet bellmouth from the gas turbine;

removing a housing from over the bearing of the gas turbine;

mounting a bearing maintenance apparatus adjacent the inlet bellmouth and the bearing, wherein the bearing maintenance apparatus includes a first platform spanning between a set of rails and a second platform suspended from the set of rails; and performing maintenance on the bearing area while the sections of the inlet bellmouth remain separated, wherein while performing the in-situ maintenance, the bearing maintenance apparatus is mounted to the gas turbine such that an operator can access the bearing area from below the shaft.

10. The method of claim 9, wherein the bearing maintenance apparatus further comprises:

a lifting device coupled to the first platform for engaging the inlet bellmouth.

11. The method of claim 10, wherein while the bearing maintenance apparatus is mounted to the gas turbine, the second platform is positioned below the bearing area enabling the operator to access the bearing area from below the shaft.

12. The method of claim 10, wherein the rails are separated by a distance that is less than approximately an outer diameter of the bearing housing and greater than approximately an inner diameter of the bearing housing.

13. The method of claim 12, wherein the rails comprise mounts adapted to couple with the gas turbine.

* * * * *